United States Patent [19]

Schnell

[11] 4,369,917

[45] Jan. 25, 1983

[54] CENTRAL HEATING SYSTEM

[76] Inventor: Carl T. Schnell, P.O. Box 374, Motala, Sweden, S-591 24

[21] Appl. No.: 118,728

[22] Filed: Feb. 5, 1980

[30] Foreign Application Priority Data

Feb. 9, 1979 [SE] Sweden ..... 7901146

[51] Int. Cl.[3] ..... F24D 1/04; F01K 13/02

[52] U.S. Cl. ..... 237/12.1; 237/67; 60/656

[58] Field of Search ..... 237/12.1, 67; 236/10; 60/648, 656

[56] References Cited

U.S. PATENT DOCUMENTS

| | | | |
|---|---|---|---|
| 324,828 | 9/1885 | Gassett | 237/12.1 |
| 1,551,438 | 8/1925 | Staley | 60/656 |
| 2,309,356 | 1/1943 | Peterson | 237/12.1 |
| 2,501,627 | 3/1950 | Findley | 236/10 |

FOREIGN PATENT DOCUMENTS

| | | | |
|---|---|---|---|
| 660687 | 2/1929 | France | 237/12.1 |

*Primary Examiner*—William E. Wayner
*Assistant Examiner*—Henry Bennett
*Attorney, Agent, or Firm*—Laff, Whitesel, Conte & Saret

[57] ABSTRACT

A central heating system includes a boiler and uses a burner to heat a heat carrying medium, which is in the form of a liquid. The system includes also one or more chargeable electric batteries, an electric generator for charging these batteries, a steam engine for operating the generator, and a steam generator for powering the steam engine. The steam generator receives its heat, for the steam generation, from the flame of the burner and delivers this steam to the steam engine, thereby operating the electric generator. This electric generator is dimensioned to give the batteries a total amount of charging energy which exceeds the total amount of energy that is required by the electric current consumpting apparatus.

5 Claims, 1 Drawing Figure

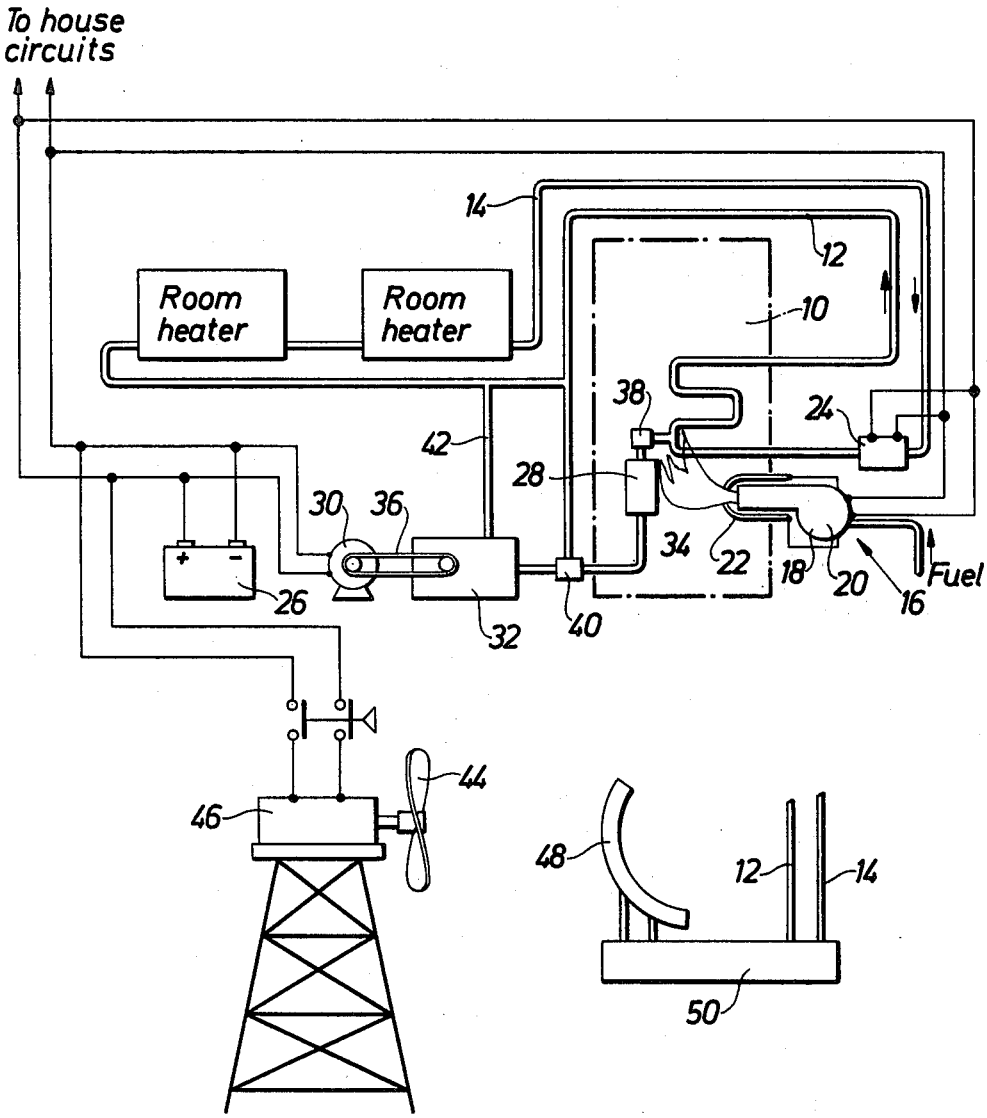
To house circuits
Room heater
Room heater
14
12
10
38
24
42
28
30
36
34
22
18
20
16
Fuel
26
32
40
44
46
48
12
14
50

CENTRAL HEATING SYSTEM

This invention relates to a central heating system having a boiler 10 using a liquid as a heat carrying medium 12, 14 and provided with a burner 16 for heating the liquid. The burner includes an electrically operated pump 18 for the fuel supply, an electrically operated fan 20 for supplying the combustion air, and electrically operated ignition electrodes 22. The system eventually also includes an electrically operated pump 24 for circulating of the heat carrying medium.

An object of the invention is to provide a system, of this type, which is independent of the distribution of electricity over general power lines. These lines are now and then exposed to break downs, which, in the case of a long extended loss of power, especially during the winter, causes considerable disadvantages to one, who for heating his house is dependent of such electric power.

Another object of the invention is to provide such a heating system which can be used, also, in places which have not been or cannot be reached by the general power lines of the power companies.

A further object of the invention is to provide a system which can be located in a normal boiler-room without requiring such extra steps as may be required if the electric current consumpting apparatus is constantly fed from a diesel operated electric generator. Or in the case of a power failure, such a generator should be started to supply, only in these cases, the electric current consumpting apparatus, with the necessary power.

A further object of the invention is to provide a system which, without any considerable extra costs, can be dimensioned to give the boiler-room the necessary lighting current or even to give the whole house its entire household current. This applies especially to weekend and holiday cottages and similar buildings.

The single sheet of drawing schematically shows the inventive heating system.

According to the present invention the system includes a chargeable electric battery 26, an electric generator 30 for charging said battery, a steam engine 32 and a steam generator 28. The steam generator is located so that it directly or indirectly is heated by the flame 34 of the burner, thereby generating steam to be supplied for operating the steam engine. The rotational movement of the steam engine is transferred at belt 36 to the electric generator, which is dimensioned to give a charging electric energy which exceeds the total electric energy required by the electric consumpting apparatus.

Thus, according to the invention, a burner operated boiler (e.g. for oil firing) is provided with a steam generator which supplies a steam engine with steam. This steam engine rotates an electric generator, charging one or more batteries. These batteries can be connected in parallel or series in order to provide enough capacity and the voltage required, e.g. 24 volts. The batteries operates the electric apparatus which is necessary for the heating system, such as an oil pump 18, fan 20 and ignition electrodes 22 for the burner 16. Usually there also is a pump 24 for circulating the water utilized as the heat carrying medium. The electric generator must be so dimensioned that it generates a charging electric energy which exceeds the sum of the total electric energy required by the electric current consumpting apparatus.

The steam generator 28 is so located that it directly or indirectly rceives from the burner flame the heat required by the steam generator.

When the boiler is started, all required energy is taken from the battery. Not until the steam generator has begun to generate steam can the steam engine and thus the electric generator assist in supplying electric current.

The water to the steam generator is supplied from the pressurized water system of the boiler, with the water moved by a circulation pump 24. A level control 38 device is used to limit the water level in the steam generator 28. Between this generator and the steam engine is a relief valve 40, which opens and releases the steam to a suitable part of the water system of the boiler 16, if the steam pressure exceeds a certain value.

The exhaust steam from the steam engine is condensed by being released into the same water system 42.

The present invention is of special importance for weekend or holiday cottages or other houses in the Alps or other mountain regions, which cannot use the regular power lines. It is also possible to utilize, during summer time, the wind and operate the electric generator 30 or a separator generator 46 by an air propeller 44 to charge the batteries, when the boiler is not needed for heating purposes. In that way, the air power provides the required household electric current. When during the same time sun heat collectors 48 are used, it is also possible to provide hot water which is supplied to a hot-water tank 50, which during winter time is served from the central heating device.

Through the use of the invention it is possible to provide an electric charging device which can be used indoors without any annoying or dangerous exhaust gases.

I claim:

1. A central building heating system having boiler means using a liquid as a heat carrying medium for conveying heat from said boiler to said building, burner means for heating said liquid, steam generating means and room heating means and said boiler being interconnected by conduits for said heat carrying medium, said steam generator means being located to be heated by a flame of the burner means, liquid level control means for supplying the medium to the steam generating means and said conduits extending from said boiler to the room heating means, relief valve means for returning steam from said steam generating means to said room heating means when steam pressure exceeds a predetermined value, electrical apparatus initially requiring electrical power before said system can be started, said burner means including an electrically operated pump which must be initially operated for supplying fuel, electrically operated fan means which must be initially operated for supplying combustions air, electrically operated ignition electrodes which must be initially operated to ignite said fuel, the system also including an electrically operated pump means for circulating the heat carrying medium through said conduits after said heating system is in operation, a chargeable electric battery for providing the initial power required for said initial operations, electric generator means for charging said battery and operating said electrical apparatus, steam engine means connected to said steam generator via said relief valve means and driven by steam from said steam generating means after said heating system is in operation, means directly responsive to the rotational movement of the steam engine means after said heating system is in operation for driving the electric generator means, which is dimensioned to give charging electric energy which exceeds the total electric energy required to drive the electric current consuming apparatus, whereby said apparatus is operated and said battery is recharged by said electric generating means.

2. A central heating system for heating a building, said system having boiler means and room heaters interconnected by a liquid distribution system using a liquid as a heat carrying medium for heating said building, said system also having electrical apparatus which is required to start said heating system, burner means for heating said liquid in a steam generating means associated with said boiler, the level of said liquid in said steam generating means being controlled on one side by a liquid level controller and on the other side by a relief valve, said electrical apparatus including at least an electrically operated pump for supplying fuel, electrically operated fan means for supplying combustions air, electrically operated ignition electrodes for starting said burner means, and an electrically operated pump means for circulating the heat carrying medium throughout said building, a chargeable electric battery for providing initial power to said electrical apparatus to start said system, electric generator means for charging said battery, steam engine means coupled to said steam generating means via said relief valve for generating steam for operating the steam engine means, the liquid being supplied to said steam generating means via said level controller with said liquid being taken from the boiler and the exhaust steam from the steam engine being condensed by being released into a suitable part of said liquid distribution system, means responsive to the rotational movement of the steam engine means for driving the electric generator means and powering said electrical apparatus, said electrical generating means being dimensioned to give charging electric energy which exceeds the total electric energy required by the electric current consumpting apparatus.

3. The system according to claim 2, in which a level control means limits the water level in the steam generator.

4. The system according to claim 2, in which a relief valve means is located between the steam generator means and the steam engine means in order to release steam to the normal liquid distribution system of the boiler means, when steam pressure exceeds a certain value.

5. The system according to claim 1, in which the electric generator means and the steam engine means are dimensioned to give a charging capacity such that the battery can supply the total electric current required by a household for its operation.

* * * * *